United States Patent [19]

Simson

[11] Patent Number: 4,633,903

[45] Date of Patent: Jan. 6, 1987

[54] DISTRIBUTING CONTROL VALVE WITH HYDRAULIC CONTROL

[75] Inventor: Dionizy Simson, Winterthur, Switzerland

[73] Assignee: ENFO Grundlagenforschungs AG, Döttingen, Switzerland

[21] Appl. No.: 732,724

[22] Filed: May 10, 1985

[30] Foreign Application Priority Data

May 11, 1984 [CH] Switzerland ..... 2356/84

[51] Int. Cl.[4] ..... F15B 13/02

[52] U.S. Cl. ..... 137/624.13; 91/40; 137/596; 137/624.14; 137/865; 137/869

[58] Field of Search ..... 91/39, 40; 137/624.13, 137/624.14, 596, 865, 869; 251/248

[56] References Cited

U.S. PATENT DOCUMENTS

| | | | |
|---|---|---|---|
| 2,178,182 | 10/1939 | Mellinger | 137/865 |
| 2,837,115 | 6/1958 | Bancroft | 137/865 X |
| 3,499,465 | 3/1970 | Roop | 137/624.13 |
| 3,654,961 | 4/1972 | Phillips | 137/624.13 |
| 4,373,874 | 2/1983 | Phillips | 91/40 X |
| 4,478,248 | 10/1984 | De Vall et al. | 91/40 X |

FOREIGN PATENT DOCUMENTS

| | | | |
|---|---|---|---|
| 298935 | 10/1928 | United Kingdom | 91/40 |

*Primary Examiner*—Gerald A. Michalsky

*Attorney, Agent, or Firm*—Watson, Cole, Grindle & Watson

[57] ABSTRACT

A 4/2 type distributing control valve characterized by compactness, ruggedness and high sampling frequency, the valve comprising two index plates (6, 7), each having teeth about its perimeter, provided with axial switching bores (8, 9, 10, 11). The two switching bores for each plate are connected with a groove (12, 13) which extends over the center of the relevant index plate.

10 Claims, 11 Drawing Figures

Figure 3:
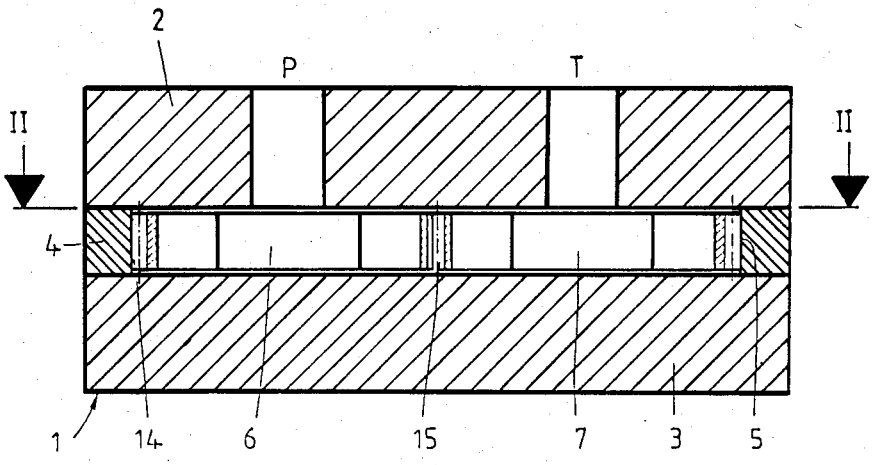

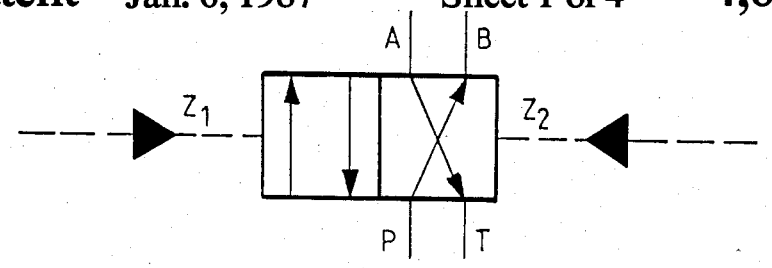
FIG. 1
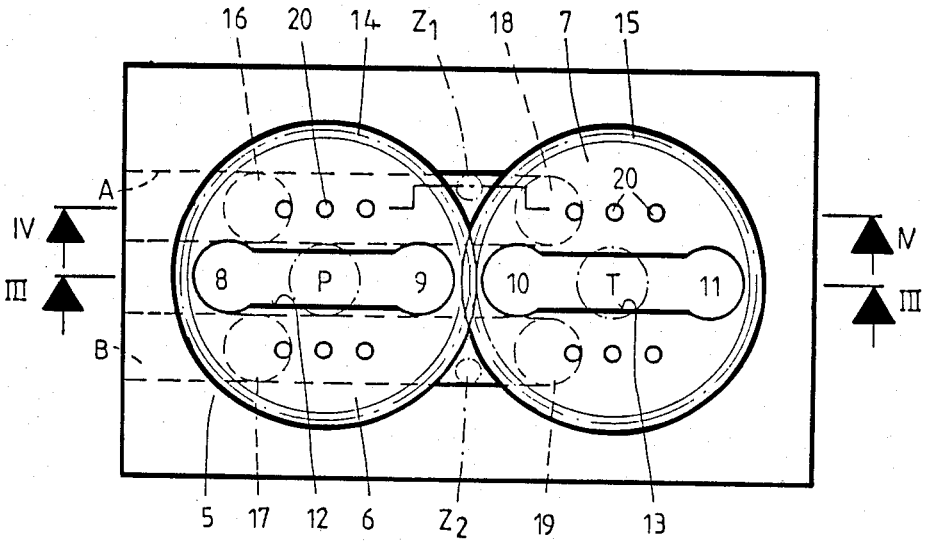
FIG. 2
FIG. 5
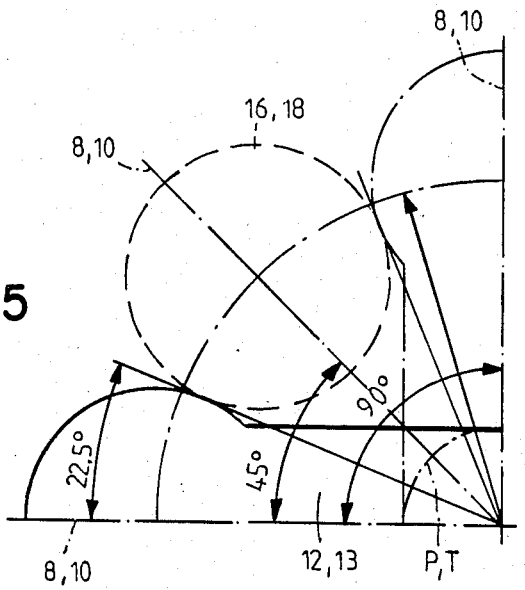

DISTRIBUTING CONTROL VALVE WITH HYDRAULIC CONTROL

The present invention relates to a distributing control valve, and more particularly, to a distributing control valve having hydraulic control which, in a preferred embodiment, is adapted for use in a vibrational ram.

Hydraulic distributing control valves are known generally as seat valves or as valves with longitudinal or rotary valves. Control for the valve is accomplished mechanically, electro-magnetically or hydraulically. The sampling frequency and ruggedness of the valve is generally dependent on the particular construction. For use in a vibrational ram, none of the valves of conventional construction can be utilized, since the demands of compactness, ruggedness (acceleration up to 300 g) and sampling frequency are much too high.

It is therefore a feature of the present invention to provide a distributing control valve which is compact and rugged and is capable of high sampling frequency.

Another feature of the present invention is to provide a distributing control valve which is suitable for incorporation into hydraulic vibro-rams.

Briefly, in its broader aspects, the present invention comprehends a distributing control valve with hydraulic control, the valve comprising a valve housing having bores for intake and return of an operational medium, the housing containing two index plates, each plate having teeth about its perimeter, at least one axial switching bore, and a groove which connects the switching bore with a bore in the valve housing.

Further objects, advantages and features of the present invention will become more fully apparent from a detailed consideration of the arrangement and construction of the constituent parts as set forth in the following description taken together with the accompanying drawing.

Figure 4:
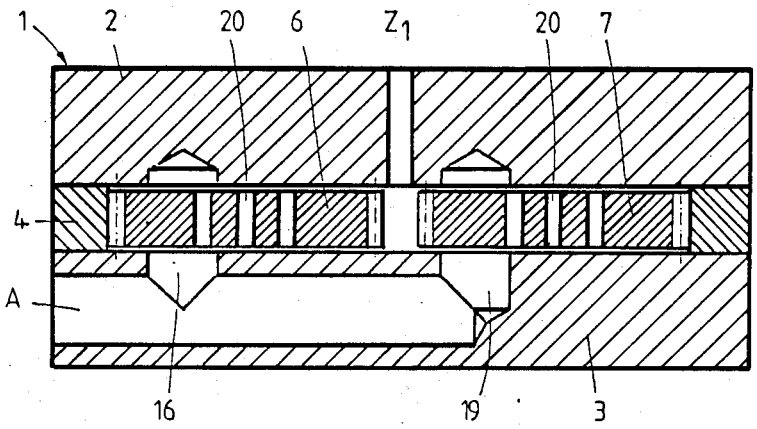
Figure 7:
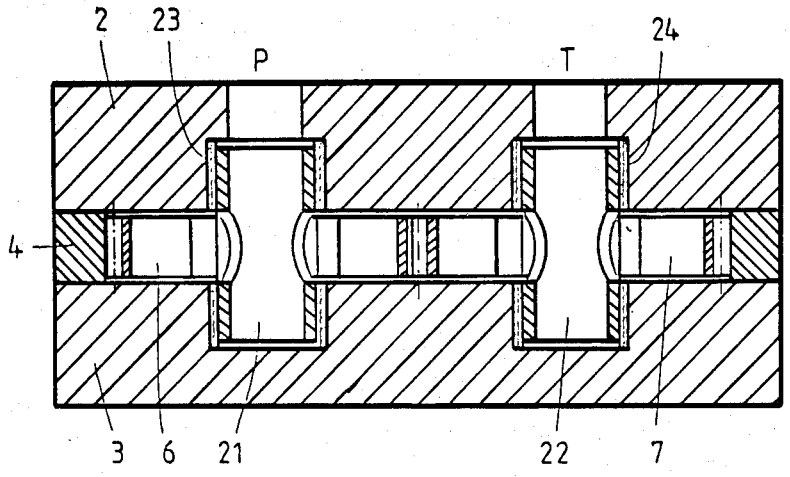
Figure 8:
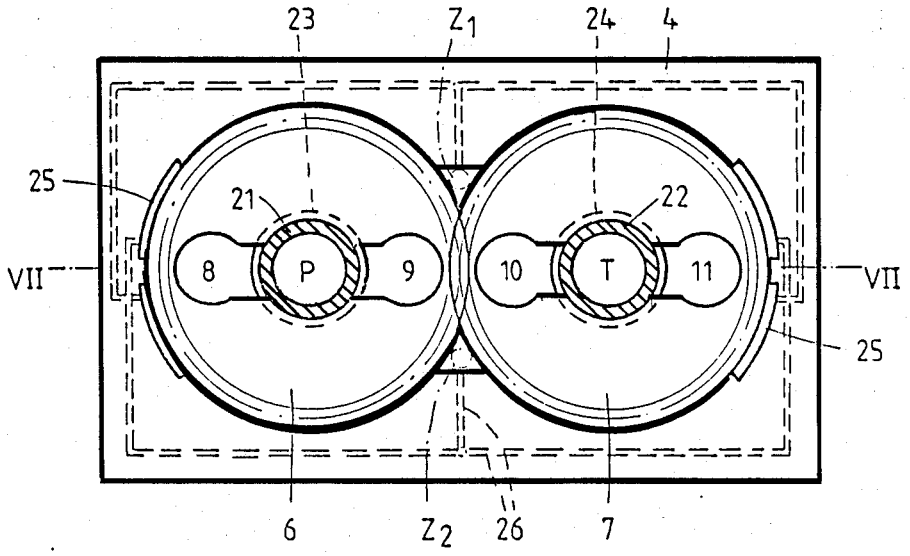

In the drawing,

FIG. 1 is a functional schematic of a distributing control valve with hydraulic control, FIG. 2 is a sectional view of one embodiment of the present invention, the view taken along line II—II of FIG. 3, FIG. 3 is a sectional view taken along line III—III of FIG. 2, FIG. 4 is a sectional view taken along line IV—IV of FIG. 2, FIG. 5 shows two varying positions of a switching bore in an index plate relative to a bore in a valve housing, FIGS. *6a–6d* show four varying positions of both grooves in the index plates relative to the bores in the valve housing, FIG. 7 is a sectional view of a further embodiment of the invention, the view taken along line VII—VII of FIG. 8, and FIG. 8 is a top view of the valve housing of a second embodiment of the invention, the upper housing portion having been removed for clarity.

Referring now to FIG. 1 which is a functional schematic of a 4/2 type distributing control valve having fluid inlet line P and fluid return line T which may be connected to either of lines A or B by operation of the valve. $Z_1$ and $Z_2$ represent hydraulic control for the distributing control valve.

One embodiment of a distributing control valve according to the present invention is shown in FIGS. 2–4.

The valve comprises valve housing 1 having upper housing portion 2 and a lower housing portion 3. Between upper and the lower housing portions 2 and 3 is spacer plate 4 having collar-shaped receptacle 5 containing two index plates 6 and 7. Upper housing portion 2, lower housing 3 and spacer plate 4 are provided with linings (not shown) and are connected to each other by screws and center pins (also not shown).

Index plates 6 and 7 are arranged in leakproof valve housing 1 with positive allowance. Plates 6 and 7 each has two axial switching bores 8 and 9, and 10 and 11, respectively. Alternatively, only one, or three or more bores per index plate could be provided as well. The pairs of switching bores 8 and 9, and 10 and 11, are each connected with a groove 12 or 13 respectively, extending across the center of index plates 6 and 7. Index plates 6 and 7 are provided at their perimeter with an involute teeth 14 and 15 respectively.

In upper housing 2 is axial intake bore P over the center of index plate 6. Axial bores 16 and 17 in upper and lower housing portions 2 and 3 are spaced the same radial distance from the center of index plate 6 as switching bores 8 and 9. In a like manner, axial bores 18 and 19 in upper and lower housing portions 2 and 3 are spaced the same radial distance from the center of index plate 7 as switching bores 10 and 11. Axial bores 16 and 18 are connected to each other by horizontal channel A located in lower housing portion 3, and axial bores 17 and 19 are connected by horizontal channel B likewise provided in the lower housing portion 3. Vertical bores 16, 17, 18 and 19 extend into both upper and lower housing portions 2 and 3 but the bores in the upper housing portion are closed yet have the same diameter and the same position as the bores opposing them in the lower housing portion. These closed portions of bores 16–19 tend to effect a pressure compensation in operation of the distributing control valve.

Index plates 6 and 7 each has two rows of axial pressure-compensation bores 20 which are arranged parallel to grooves 12 and 13. Thus, when either of index plates 6 and 7 is in a closed position, i.e., when none of the switching bores 8–11 of the index plate communicates with vertical bores 16, 17, 18 and 19 in the housing, the switching bores in the lower and upper housing portions are connected with each other by one pressure-compensation bore 20.

Drive medium for control of the valve is taken in, or respectively lead out, by one of two bores $Z_1$ and $Z_2$ provided in upper housing portion 2. The operational or drive medium from one bore $Z_1$ or $Z_2$ enters the valve in the region of teeth 14 and 15 of both index plates 6 and 7, and through the other bore, the operational medium flows back to a container (not shown) located exteriorly of the valve. The rotational speed of index plates 6 and 7 is thus dependent on the rate of flow of the drive medium and can be controlled from the exterior. Both index plates 6 and 7 rotate synchronously due to teeth 14 and 15 engaging each other, so that switching bores 8, 9, 10 and 11 in the index plates pass through bores 16, 17, 18 and 19 found in the upper and lower housing portions 2 and 3.

In FIG. 5, the state of each switching bore is represented in two varying, closed positions. In positions between these states, switching bore 8 or 10 communicates with bore 16 or 18 in the valve housing.

In FIGS. *6a–6d*, index plates 6 and 7, more specifically, grooves 12 and 14 on the plates, are represented in four varying positions. In the positions shown in FIGS.

Figure 6:
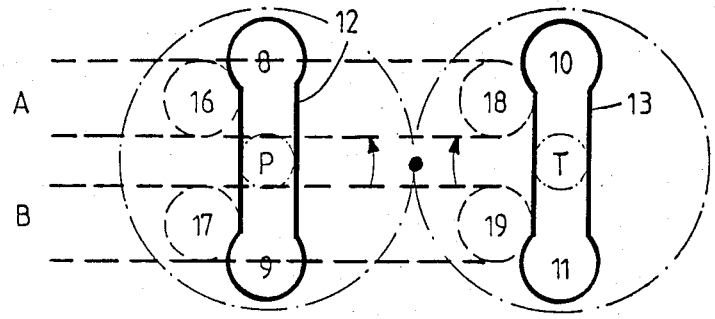
Figure 6:
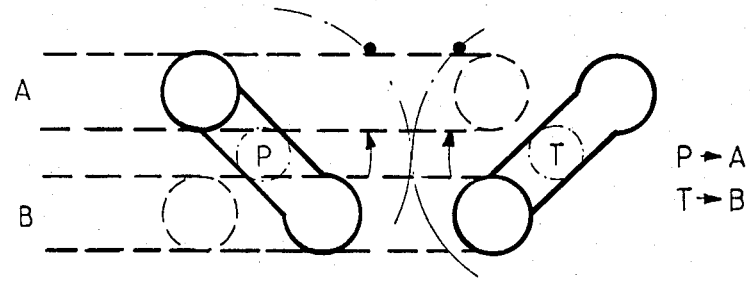
Figure 6:
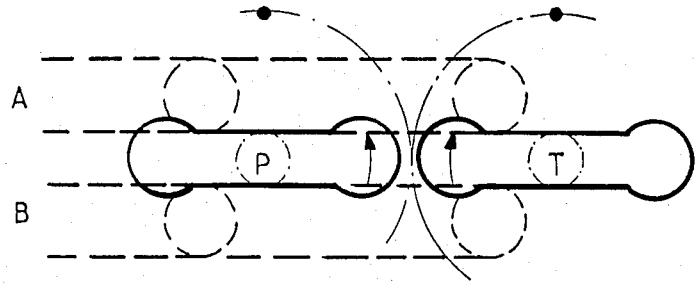
Figure 6:
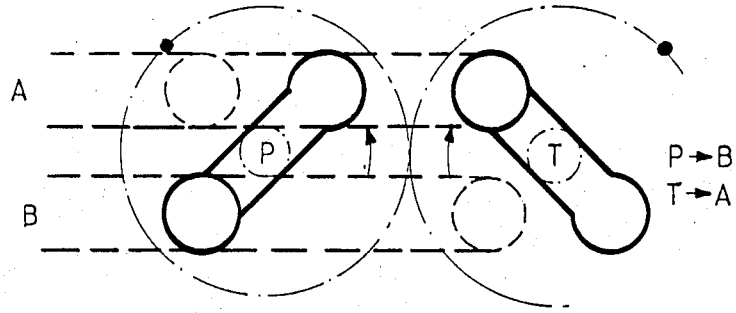

6*a* and *c*, intake bore P or return bore T are not connected with channels A and B. In the position shown in FIG. 6*b*, intake bore P of the left index plate is connected with channel A and return bore T is connected with channel B. In the position shown in FIG. 6*d*, intake bore P of the left index plate is connected with channel B and return bore T of the right index plate is connected with channel A.

The circular points in FIGS. 6*a–d* represent two random points at the perimeter of each of the index plates 6 and 7 and make clear the synchronous rotational movement of the index plates under the influence of the drive medium. Each groove 12 and 13 in index plates 6 and 7 permanently connects two switching bores 8 and 9, or 10 and 11 respectively, provided in the plates, with bore P for the operational medium intake, or respectively with the bore T for operational medium return. With one complete rotation of index plates 6 and 7, two switching cycles result. The intake operational pressure is completely balanced in each index plate both axially and radially. All effective surfaces are symmetrical such that during the closing process by index plates 6 and 7, the pressure of both sides is balanced by pressure-compensation bores 20 in the index plates. Thus, if one or several of bores 16, 17, 18 and 19 in valve housing 1 are blocked by index plates 6 and 7, the index plates will not be pressed against the upper housing portion. Radial forces produced by the pressure of the operational medium can be transferred through the course surface at the teeth points at spacer plate 4.

In FIGS. 7 and 8, another embodiment of the invention is shown where FIG. 7 is a sectional view taken along line VII—VII of FIG. 8. In contrast to the embodiment of FIGS. 2–4, each index plate 16 and 17 is provided with hollow bearing neck 21 and 22 respectively, which transfer radial forces to bearing bushings 23 and 24 in housing portions 2 and 3. The radial forces are largely reduced through balancing grooves 25 and balancing channels 26 in spacer plate 4.

In a further non-illustrated embodiment, only one switching bore is provided for each index plate and thus the groove in the index plate which connects the switching bore with the intake or return bore respectively in the housing can be of reduced length.

When the above-described valves are utilized with a vibro-ram, channels A and B provided in the lower housing portion 3 are connected with ducts which lead to a vibrational cylinder, where alternately first one piston side, then the other piston side, is provided with pressure.

While there has been shown and described what is considered to be preferred embodiments of the present invention, it will be apparent to those skilled in the art that various changes and modifications may be made therein without departing from the invention as defined in the appended claims.

It is claimed:

1. A distributing control valve with hydraulic control, comprising a valve housing having bores for intake and return of a hydraulic medium, the housing containing two circular index plates, each plate having teeth about its periphery and being rotatably mounted on a rotational axis within a cylindrical chamber such that the teeth of one plate mesh with the teeth of the other plate, each index plate also having at least one switching bore extending through the plate on an axis parallel to the rotational axis of the plate and a groove extending radially from the switching bore to the axis of the plate thereby connecting the switching bore with a bore for the hydraulic medium, the housing further including two control channels, each control channel extending to the exterior of the housing and including a control channel bore having an axis parallel to the rotational axes of the index plates and spaced radially from one of said plate axes the same distance as is the axis of the switching bore of that index plate.

2. A valve according to claim 1, wherein each index plate has two switching bores arranged symmetrically about the axis of the plate, the two switching bores being connected by the groove.

3. A valve according to claim 2, wherein the housing comprises an upper housing portion, a lower housing portion, and a spacer plate between the two housing portions.

4. A valve according to claim 2, wherein the index plates are each provided with pressure-compression bores.

5. A valve according to claim 2, wherein each control channel includes two control channel bores, one extending to one index plate and the other to the other index plate.

6. A valve according to claim 1, wherein the housing comprises an upper housing portion, a lower housing portion, and a spacer plate between the two housing portions.

7. A valve according to claim 1, wherein the index plates are each provided with pressure-compression bores.

8. A valve according to claim 1, wherein the valve housing includes bores for intake and return of a medium for driving the index plates.

9. A valve according to claim 1, wherein each index plate has a bearing neck connected thereto, the bearing neck being carried within a bushing in the valve housing.

10. A valve according to claim 1, wherein balancing grooves are provided in the region of the index plates in the valve housing, the balancing channels connecting balancing grooves.

* * * * *